US008348690B2

(12) United States Patent
Allain et al.

(10) Patent No.: US 8,348,690 B2
(45) Date of Patent: Jan. 8, 2013

(54) PROCESS FOR THE PRODUCTION OF A CONNECTING ELEMENT FOR A BAYONET CONNECTOR AND CONNECTING DEVICE

(75) Inventors: Patrick Allain, Juigne sur Sarthe (FR); Alain Hamon, Noyen sur Sarthe (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 13/035,165

(22) Filed: Feb. 25, 2011

(65) Prior Publication Data

US 2011/0206333 A1 Aug. 25, 2011

(30) Foreign Application Priority Data

Feb. 25, 2010 (FR) ..... 10 51359

(51) Int. Cl.
*H01R 4/50* (2006.01)

(52) U.S. Cl. ..... 439/335

(58) Field of Classification Search ..... 439/335–336, 439/312–321

See application file for complete search history.

(56) References Cited

U.S. PATENT DOCUMENTS 3,470,524 A 9/1969 Culver
5,256,077 A * 10/1993 Mattingly et al. ..... 439/314
5,383,272 A * 1/1995 Mattingly et al. ..... 29/876
5,982,602 A * 11/1999 Tellas et al. ..... 361/119
6,808,407 B1 10/2004 Cannon

OTHER PUBLICATIONS

French Search Report, dated Oct. 14, 2010, from corresponding French application.

* cited by examiner

*Primary Examiner* — Jean F Duverne
(74) *Attorney, Agent, or Firm* — Young & Thompson

(57) ABSTRACT

A bayonet connecting element and a process for the production of such a connecting element (1) for an electrical or optical connector, according to which a body (2), with a general hollow cylindrical shape, is produced, includes the following additional stages:

a) a through bore (12) is made by piercing a wall (5) of the body of the connecting element from the outer surface (10) of the wall;

b) the outer surface of the wall around the bore is machined in such a way as to hollow out a flat surface (11) around the bore;

c) a lug (4) is inserted into the bore, from the outer surface of the wall, in such a way that a head (8) of the lug is projecting from the outer surface of the wall of the connecting element.

13 Claims, 2 Drawing Sheets

PROCESS FOR THE PRODUCTION OF A CONNECTING ELEMENT FOR A BAYONET CONNECTOR AND CONNECTING DEVICE

The invention relates to a process for the production of a connecting element, such as a base, for a bayonet connector. More specifically, the invention relates to the mounting of lugs that work with the bayonet system of the connector on the primary body of the corresponding connecting element.

It is known to lock the connection between a plug and an electrical connector base, for example, by means of a bayonet system. More specifically, the plug is equipped with a locking ring that is stationary in translation and that is able to be locked on the outside wall of the complementary base when the connection between the contacts of the plug and the contacts of the base is executed. The primary body of the base is itself equipped with lugs extending in radial projection toward the outside from the outside wall of the base. These lugs are designed to work with grooves that are hollowed out in the inside wall of the locking ring. At the end of the locking of the ring around the base, the lugs extend into the openings that are made at the ends of the grooves so as to make the locking of the plug and the base irreversible, or at least to make accidental unlocking impossible.

Such a bayonet locking device offers a major advantage from the standpoint of the rapidity of locking It is therefore widely used in many areas, such as that of civil or military aeronautics, or any other application in a rigorous environment.

Numerous embodiments of lugs on the body of the base are known. For example, the lugs can be trimmed in mass. They are then made of the same material as the body of the base and have the mechanical characteristics of this material. With the lugs being parts that are subject to wear and tear, when the body is made of a light alloy, the resistance to wear and tear is then less than when the body is made of stainless steel. Otherwise, the lugs can be connected mechanically, and, in this case, they can be made of a completely different material and in particular of stainless steel, so as to meet the requirements of wear and tear. Thus, it is known to connect the stainless steel lugs to a base body made of aluminum alloy. The body of the base is to be treated in such a way as to withstand corrosion, however. Such a treatment most often consists of a protective layer, applied by chemical or electrolytical deposition or galvanoplasty. This protective layer makes it possible for such a connector to withstand different types of damage from the environment and, in particular, to withstand moist environments by eliminating risks of corrosion or rust.

Connector standards require a visual reference, of color, at the top of the lugs. The user should be able to see the lugs through the holes of the locking ring when the locking is achieved. Most often, the lugs are connected to the body of the base once the deposition of the anti-corrosion protective layer is executed, so that the body of the base has a uniform color, corresponding to that of the anti-corrosion layer, different from those of the lugs connected later. Otherwise, it is also possible to initiate the anti-corrosion deposition after the installation of lugs on the body of the base. In this case, it is necessary, hereinafter, to paint the tops of the lugs with a different color. This second solution proves tedious and expensive.

This is why, in a first step, it is most often preferred to deposit the protective layer and then next to install the lugs.

The increasingly strict environmental standards now prevent the use of certain compounds considered to be harmful to the environment. Thus, cadmium and chromium VI find themselves prohibited for the production of such protective layers because of their strong toxicity relative to the environment. It has therefore been necessary to find substitutes for the execution of this anti-corrosion deposition. However, the compositions that are currently used for the production of the protective layer do not exhibit the same ductility as those that are rich in cadmium and are therefore much more brittle than the latter. In the current devices, it is therefore common that the mechanical constraints between certain contact points of the lugs on the base that is covered by the anti-corrosion layer result in breaks of this protective layer. In addition, the very installation of the lugs on the base, which requires an insertion by force of said lug into the corresponding opening that is made on the base, can cause cracks in the protective layer. These cracks and breaks are therefore concentrated in the contact zone between the lug and the opening on the base, allowing the raw material that is used for producing the body of the base to appear. The anti-corrosion function of the protective layer is therefore not maintained in these zones. The device in its entirety finds itself weakened.

Also, in the invention, an attempt is made to provide a process for the production of a connecting element for a bayonet connector, such as a base that does not have some or all of the drawbacks cited above. Another object of the invention is to produce a connecting element for a bayonet connector, which is equipped with lugs and which is able to withstand mechanical constraints in particular at the connecting zone with the lugs, regardless of the nature of the coating that can cover said connecting element.

For this purpose, the invention proposes to make level, for example by spot-facing, the surface that borders the protruding ends of the openings that are made on the wall of the connecting element and that are designed to accommodate the lugs. More specifically, according to the invention, the burrs on the outer surface of the connecting element, which result from the piercing and which border the corresponding opening, are eliminated or at least forced to the outside, in such a way that the outer surface of the connecting element has a flat surface, with neither rough spots nor projections, at least opposite the head of the lug that will come into contact against it. Actually, when the wall of the body of the connecting element is pierced, there is a reflux of material that forms a ring of material around the protruding end of the opening that is obtained. However, it is just at the level of this burr, therefore concentrated on the outer periphery of the opening, that the head of the lug that is housed in the opening is going to rest. Since the surface area of the head of the lug is very small, the pressure that is exerted by the head on the connecting element is concentrated at this irregular surface. With the mechanical stresses therefore being very high in this small contact zone, when the surface on which these stresses are exerted is not very ductile, in particular in the case where the connecting element is covered by an anti-corrosion layer, breaks and cracks can appear. The invention therefore proposes to eliminate or push back this reflux of raw material beyond the contact zone between the connecting element and the lug head. Thus, a perfectly flat and smooth surface is made around the protruding end of the opening. The head of the lug then comes into contact with a flat and smooth surface, which makes it possible to limit the mechanical stresses between the lug head and the outer surface of the connecting element. Furthermore, according to the invention, so as to further reduce the potential mechanical stresses at the contact zone between the head of the lug and the outer surface of the connecting element, it is possible to plane the wall of the connecting element that borders the opening to form a convex curve and to eliminate any sharp ridge between the flat surface that borders the opening and the opening itself. The presence of this curve at the level of the opening makes it possible to facilitate the insertion of the lug and to avoid having a circular imperfection with an acute angle between the opening and the bottom of the spot-facing. Actually, an acute angle intersection can exhibit fine machining burrs that weaken the protection that covers the part. In addition, even without burrs, during the deposition operation of the protective layer, for example by galvanoplasty, the thickness of the deposited layer is difficult to control in this intersection because of the point effect. The fact of producing a curve, or at least beveling this intersection, makes it possible to eliminate the risks of excess thickness and therefore burrs during the anti-corrosion deposition. The contact zone between the shoulder of the lug, at the level of the junction between the head of the lug and the body of said lug, and the wall of the connecting element is thus smoothed.

The invention therefore has as its object a process for the production of a connecting element, such as a base, with a bayonet for a connector, in particular electrical or optical, according to which a connecting element body with a general hollow cylindrical shape is produced, characterized in that it comprises the following additional stages:

a) A through bore is made by piercing the wall of the body of the connecting element, from the outer surface of said wall;

b) The outer surface of the wall around the bore is machined in such a way as to hollow out a flat surface around said bore;

c) A lug is inserted into the bore from the outer surface of the wall in such a way that a head of the lug is projecting from the outer surface of said wall.

The body of the connecting element can be produced by molding or machining It has a cylindrical through opening that extends along a longitudinal axis of said body and protrudes at the two ends of said body. This opening is designed to accommodate an insulator that is also cylindrical and into which the contacts of the connecting element will extend along the longitudinal axis.

A flat surface is defined as a surface that does not have surface defects or irregularities, such as projections, rough spots, etc.

The outer surface of the connecting element is hollowed out in such a way that the ring of the flat surface is set back relative to the remainder of the outer surface of the connecting element.

Advantageously, the operations a) to c) are repeated for each of the lugs that have to be mounted on the wall of the connecting element.

According to the process for the production of the invention, it is possible to produce the stages a) and b) simultaneously, by means of any known tool, making possible in particular the simultaneous piercing and spot-facing of the wall.

In general, the lug is inserted by force into the corresponding bore, whose diameter is at best equal to the diameter of the lug in such a way as to meet the mechanical requirements and functional constraints to make it possible for the lugs to perform their functions.

In one particular embodiment of the invention, it is possible to provide for the arrangement of two, three or more lugs on the outer wall of the connecting element. In this case, the stages a to c are repeated as many times as there are lugs to be provided on the wall of the connecting element.

According to one example for implementing the process according to the invention, it is possible to execute the following additional stage:

d) A convex connecting radius is made at the junction between the flat surface around the bore and said bore, over the entire circumference of said bore before inserting the lug into the bore.

Convex connecting radius is defined as a junction zone between two surfaces, not having a sharp ridge. Thus, the convex connecting radius can consist of a curve but also a beveled surface.

In this case, advantageously, the convex connecting radius is produced on the wall of the body of the connecting element in such a way that it is strictly greater than a concave connecting radius at the junction between the head and the body of the lug that has to be inserted into the corresponding opening.

Preferably, the flat surface that is made around the bore has a diameter that is at least equal to the diameter of the head of the lug that has to pass through said bore.

So as to ensure that the lug is held in position on the wall of the connecting element, it is possible to execute the following additional stage:

e) The rear end of the lug, mounted in the corresponding bore, is set on the inner surface of the wall of the connecting element.

The process according to the invention advantageously makes it possible to apply an anti-corrosion protection on the outer surface of the wall of the connecting element after having produced the bore and before having inserted the lug into said bore, while ensuring the integrity of the anti-corrosion surface.

Of course, it is also possible to deposit the anti-corrosion layer only once the lugs are attached to the wall of the connecting element; in this case, as disclosed above, it is often necessary to initiate an additional subsequent stage of dyeing, etc., the heads of lugs.

The invention also relates to a connecting element for a bayonet connector that comprises a hollow, cylindrical, primary body that is designed to accommodate electrical or optical contacts, a connecting portion of the primary body, designed to be connected to a complementary connecting element, comprising at least one through bore that is designed to accommodate a lug that projects radially toward the outside from the outer surface of the wall of the primary body, characterized in that it has a flattened-surface ring that is hollowed out from the outer surface of the wall, whereby said flattened-surface ring surrounds at least one through bore that is designed to accommodate a lug.

According to embodiments of the connecting element for a bayonet connector according to the invention, it is possible to provide all or part of the following additional characteristics:

- The flattened-surface ring has a diameter that is at least equal to the diameter of the head of the lug that the corresponding bore is designed to accommodate.
- A junction between the flattened-surface ring and the cylindrical part of the bore has a convex connecting radius.
- The connecting element comprises at least one lug that is housed in a bore that is made on the wall of said connecting element, whereby said lug has, at a junction between the head and the body, a concave connecting radius that is strictly less than the convex connecting radius of the bore in which it is housed.

The invention will be better understood from reading the following description and from examining the figures that accompany it. The latter are indicated by way of indication and are in no way limiting of the invention. The figures show:

FIG. 1 a diagrammatic representation of a base body for a bayonet connector, equipped with lugs;

FIG. 2 a diagrammatic representation of a bayonet base according to the invention at the level of a bore that is equipped with a lug;

FIG. 3 a transverse cutaway representation of the bayonet base of FIG. 2.

FIG. 1 shows a bayonet connector base 1 that is equipped with three lugs 4 (only two are visible in FIG. 1).

The base 1 is equipped with a primary body 2 of which one connecting end 3 carries lugs, or bulges, 4 of the bayonet system. The lugs 4 extend over an outer perimeter of the primary body 2. The lugs are projecting toward the outside from the outer surface 10 of the wall 5 of said primary body 2 so as to be able to work with a locking ring that is equipped with complementary openings (not shown). The primary body 2 of the base 1 is equipped with an insert 6 that extends longitudinally into the hollow body of the primary body 2, whereby said insert 6 is equipped with four longitudinal housings 7 in which contacts are designed to extend.

Figure 1:
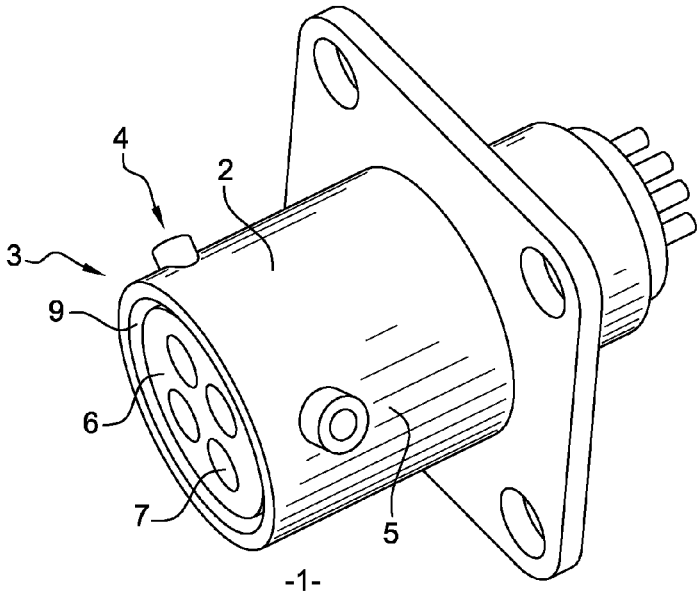
Figure 2:
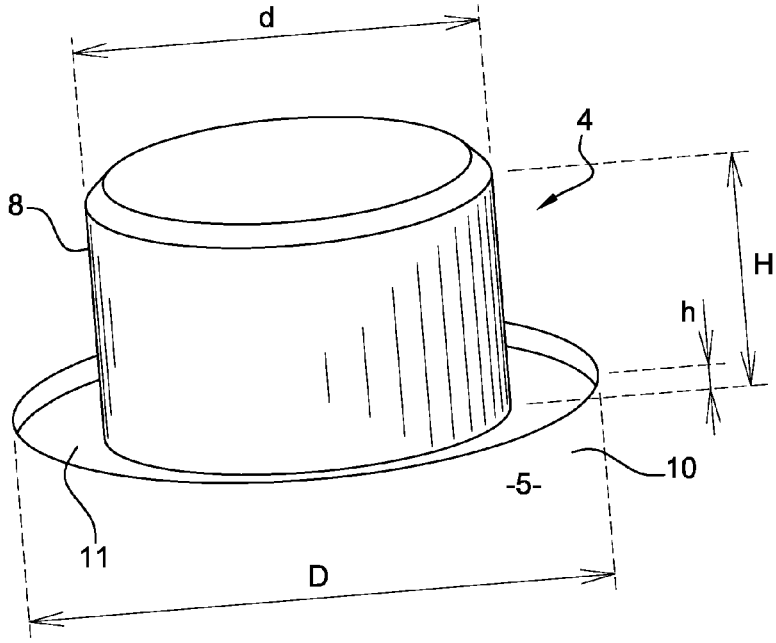
FIG. 2 depicts an enlarged view of a bulge 4 of a base as described in FIG. 1, which was installed according to the process of the invention.
Figure 3:
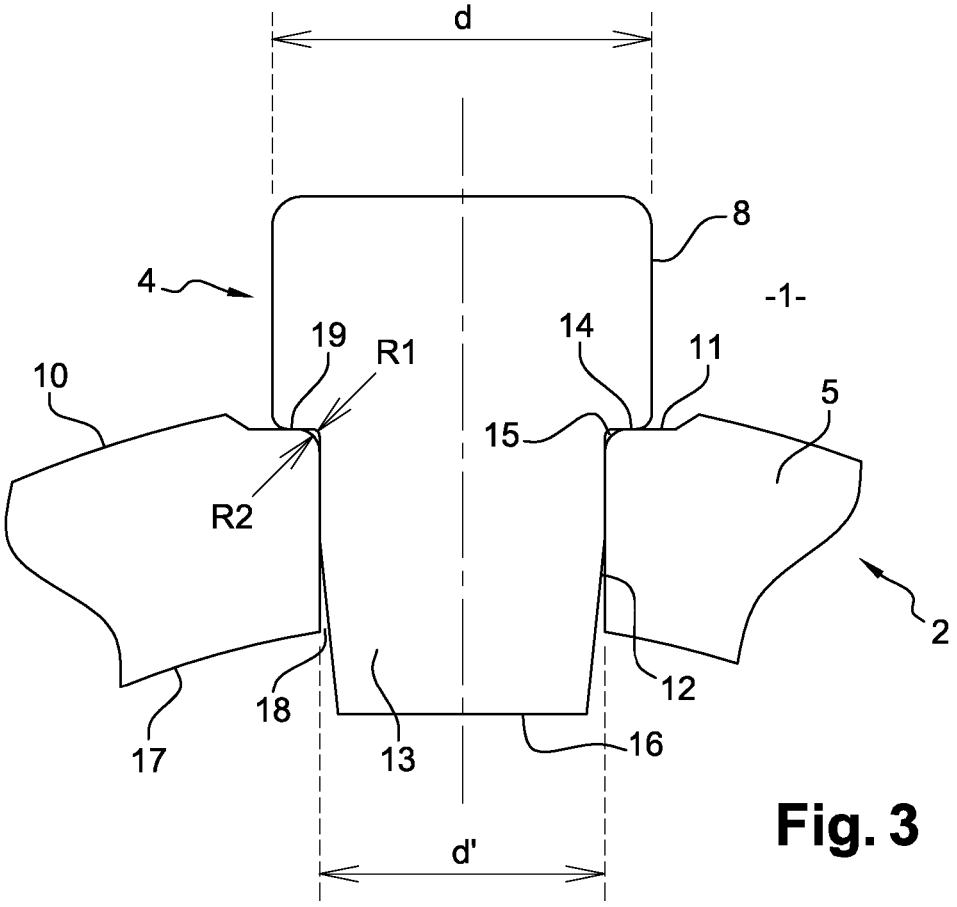
FIG. 3 shows this same enlargement in a transverse cutaway view.

The lug 4 projects from the outer surface 10 of the wall 5 of the primary body 2 of the base 1. More specifically, the lug 4 passes through the wall 5 in such a way that the body 13 of said lug is at least partially housed in a through opening 12 that is made in said wall 5, and in such a way that the head 8 of said lug 4 is projecting from the outer surface 10 of said wall 5.

A flattened-surface ring 11, or a flat-surface ring, is hollowed out from the outer surface 10 of the wall 5 and surrounds the head 8 of the lug 4. The diameter D of the flattened-surface ring 11 is strictly greater than the diameter d of the head 8 of the lug 4. The flattened-surface ring 11 has a perfectly smooth surface, with no rough spots or other surface defects.

With the flattened-surface ring 11 being hollowed out from the outer surface 10 of the wall 5, a part of the head 8 of the lug 4 is set back relative to the outer surface 10 of said wall 5. Advantageously, the height h of the housing that is formed by the flattened-surface ring 11 is low relative to the height H of the lug head 8 in such a way that it can work with the grooves of the locking ring that has to be mounted around the base 1. The height is defined from the dimension that extends radially from the wall of the base.

The flattened-surface ring 11 can be obtained, in particular by spot-facing or machining, simultaneously with or subsequently to the piercing of the through opening 12 that is made in the wall 5 of the primary body 2 of the base 1 and that is designed to accommodate the body 13 of the lug 4.

The through bore 12 is made radially in the wall 5 of the primary body 2 of the base 1 and thus protrudes through a first end 15 at the outer surface 10 of said wall 5, and through a second end 18, opposite to the first, at an inner surface 17 of said wall 5. The inner surface 17 borders the cylindrical opening 9 of the base 1.

The diameter d of the head 8 of the lug 4 is strictly greater than the diameter d' of the through bore 12 in such a way that the head 8 of the lug 4 rests on the flattened-surface ring 11.

More specifically, the shoulder 14 that corresponds to the connection between the head 8 and the cylindrical body 13 of the lug 4 rests against the flattened-surface ring 11. To the extent that all of the surface impurities and irregularities of the outer wall 5 have been forced, during spot-facing, beyond said ring 11, the surface on which the shoulder 14 rests is perfectly flat, thus reducing the mechanical stresses.

Furthermore, so as to facilitate the insertion of the cylindrical body 13 of the lug 4 into the corresponding bore 12, a convex connecting radius R2 is made at the intersection between the flat surface of the ring 11 and the first end 15 of the bore 12. Having an intersection with an acute angle between the edge of the bore 12 and the angle of the shoulder 14 is thus avoided.

This convex connecting radius R2 facilitates the introduction of the cylindrical body 13 of the lug 4 that, quite often, is to be mounted by force in the bore 12. The presence of this convex connecting radius R2 also makes it possible to reduce the risks of weakening a coating that is optionally deposited on the outer surface 10 of the wall 5.

Furthermore, in a quite systematic way, the shoulder 14 of the lug 4 has a concave connecting radius R1 at the junction between the lower flat surface 19 of the head 8, designed to rest against the flattened-surface ring 11, and the cylindrical part 13 of said lug 4, which makes it possible to reduce the mechanical stresses at the contact zone accordingly between the head 8 of the lug 4 and the outer surface 10 of the wall 5 of the base 1.

Advantageously, the convex connecting radius R2 of the bore 12 is strictly greater than the concave connecting radius R1 of the lug 4.

Furthermore, a connecting radius R2 that is equal to 0.05 cm, plus or minus 0.005 cm, is preferably selected for a lug with dimensions of between 0.15 and 0.30 cm, always provided that the convex connecting radius R2 is strictly greater than the concave connecting radius R1. Such a convex connecting radius R2, with a very low value, makes it possible to preserve the largest support surface possible at the flattened-surface ring 11 for the head 8 of the lug 7.

The outer surface 10 of the wall 5 is covered by a protective coating against corrosion, etc. The deposition of this coating can be executed by any known means and in particular by chemical or electrolytical deposition or galvanoplasty. According to the invention, this deposition is advantageously executed once the through bores 12 are produced on the outer wall 5 of the base 1 and before the lugs 4 are introduced into the corresponding bores 12.

The rear end 16 of the body 13 of the lug 4 is projecting from the inner surface 17 of the wall 5. It is thus possible to set the rear end 16 on the inner surface 17 of the wall 5 in such a way as to ensure that the lug 4 is held in position even in the case of very strong stresses.

The invention claimed is:

1. Process for the production of a bayonet connecting element (1) for a connector, according to which a connecting element body (2), with a general hollow cylindrical shape, is produced, comprising the following additional stages:

a) a through bore (12) is made by piercing a wall (5) of the body of the connecting element from the outer surface (10) of said wall;

b) the outer surface of the wall around the bore is machined in such a way as to hollow out a flat surface (11) having no surface defects or irregularities around said bore; and c) a lug (4) is inserted into the bore, from the outer surface of the wall, in such a way that a head (8) of the lug is projecting from the outer surface of the wall of the connecting element.

2. Process for the production of a bayonet connecting element according to claim 1, comprising the following additional stage:

the operations a) to c) are repeated for each of the lugs (4) that have to be mounted on the wall of the connecting element.

3. Process for the production of a bayonet connecting element according to claim 1, wherein the stages a) and b) are executed simultaneously.

4. Process for the production of a bayonet connecting element according to claim 1, comprising the following additional stage:

d) a convex connecting radius (R2) is made at the junction between the flat surface around the bore and said bore, over the entire circumference of said bore, before inserting the lug into the bore.

5. Process for the production of a bayonet connecting element according to claim 4, wherein the convex connecting radius on the wall of the body of the connecting element is made in such a way that it is strictly greater than a concave connecting radius (R1) at the junction between the head of the lug and the body of the lug.

6. Process for the production of a bayonet connecting element according to claim 1, wherein in stage b), the flat surface that is hollowed out around the bore has a diameter (D) that is at least equal to the diameter (d) of the head of the lug that has to pass through said bore.

7. Process for the production of a bayonet connecting element according to claim 1, comprising the following additional stage:

e) the rear end (16) of the lug, mounted in the corresponding bore, is set on the inner surface (17) of the wall of the connecting element.

8. Process for the production of a bayonet connecting element according to claim 1, comprising the following additional stage:

f) anti-corrosion protection is applied on the outer surface of the wall of the connecting element after having produced the bore and before having inserted the lug into said bore.

9. Connecting element (1) for a bayonet connector that comprises a hollow cylindrical primary body (2), designed to accommodate contacts, a connection portion (3) of the primary body, designed to be connected to a complementary connecting element, comprising at least one through bore (12) that is designed to accommodate a lug (4) in radial projection toward the outside from the outer surface (10) of the wall (5) of the primary body, the connecting element comprising:

a flat-surface ring (11) having no surface defects or irregularities that is hollowed out from the outer surface of the wall, with said flat-surface ring surrounding at least one through bore, and a convex connecting radius (R2) that forms a junction between the flat-surface ring and the cylindrical part of the bore.

10. Connecting element for a bayonet connector according to claim 9, wherein the flat-surface ring has a diameter (D) that is at least equal to the diameter (d) of the head (8) of the lug that the corresponding bore is designed to accommodate.

11. Connecting element for a bayonet connector, according to claim 9, further comprising at least one lug (4) that is housed in a through bore (12) that is made on the wall of said connecting element, whereby said lug has, at a junction between the top (8) and the body (13), a concave connecting radius (R1) that is strictly less than the convex connecting radius of the bore.

12. A connecting element (1) for a bayonet connector that comprises a hollow cylindrical primary body (2), designed to accommodate contacts, a connection portion (3) of the primary body, designed to be connected to a complementary connecting element, comprising at least one through bore (12) that is designed to accommodate a lug (4) in radial projection toward the outside from the outer surface (10) of the wall (5) of the primary body, the connecting element comprising:

a flat-surface ring (11) that is hollowed out from the outer surface of the wall, with said flat-surface ring surrounding at least one through bore;

a convex connecting radius (R2) that forms a junction between the flat-surface ring and the cylindrical part of the bore; and at least one lug (4) that is housed in a through bore (12) that is made on the wall of said connecting element, wherein said lug has, at a junction between the top (8) and the body (13), a concave connecting radius (R1) that is strictly less than the convex connecting radius of the bore.

13. A connecting element for a bayonet connector according to claim 12, wherein the flat-surface ring has a diameter (D) at least equal to a diameter (d) of the head of the lug that the corresponding bore is designed to accommodate.

* * * * *